US005695019A

United States Patent [19]

Shamburger, Jr.

[11] Patent Number: 5,695,019

[45] Date of Patent: Dec. 9, 1997

[54] ROTARY CONE DRILL BIT WITH TRUNCATED ROLLING CONE CUTTERS AND DOME AREA CUTTER INSERTS

[75] Inventor: James M. Shamburger, Jr., Spring, Tex.

[73] Assignee: Dresser Industries, Inc., Dallas, Tex.

[21] Appl. No.: 518,567

[22] Filed: Aug. 23, 1995

[51] Int. Cl.[6] ..... E21B 10/04; E21B 10/06

[52] U.S. Cl. ..... 175/333; 76/108.2; 175/426

[58] Field of Search ..... 175/333, 332, 175/426, 432, 404, 57; 76/108.2

[56] References Cited

U.S. PATENT DOCUMENTS

| | | | |
|---|---|---|---|
| Re. 32,036 | 11/1985 | Dennis | 175/329 |
| 1,306,674 | 6/1919 | Esseling . | |
| 1,996,322 | 4/1935 | Carlson | 255/72 |
| 2,014,806 | 9/1935 | Howard et al. | 255/72 |
| 2,081,195 | 5/1937 | Catland et al. | 255/72 |
| 2,103,611 | 12/1937 | Catland et al. | 255/72 |
| 2,117,481 | 5/1938 | Howard et al. | 255/72 |
| 2,123,453 | 7/1938 | Catland et al. | 255/72 |
| 2,358,642 | 9/1944 | Kammerer | 255/71 |
| 2,412,915 | 12/1946 | Sewell | 255/72 |
| 2,470,695 | 5/1949 | Goodwin et al. | 255/71 |
| 2,514,586 | 7/1950 | Natland et al. | 255/72 |
| 2,661,931 | 12/1953 | Swart | 255/302 |
| 2,667,334 | 1/1954 | Ortloff | 255/71 |
| 2,804,282 | 8/1957 | Spengler, Jr. | 255/345 |
| 2,893,696 | 7/1959 | McGuire | 255/72 |
| 2,901,223 | 8/1959 | Scott | 255/302 |
| 3,075,592 | 1/1963 | Overly et al. | 175/333 |
| 3,091,300 | 5/1963 | Hammer | 175/333 |
| 3,095,053 | 6/1963 | Pistole et al. | 175/329 |
| 3,100,544 | 8/1963 | Overly et al. | 175/333 |
| 3,126,067 | 3/1964 | Schumacher, Jr. | 175/374 |
| 3,134,447 | 5/1964 | McElya et al. | 175/332 |
| 3,137,355 | 6/1964 | Schumacher, Jr. | 175/374 |
| 3,174,564 | 3/1965 | Morlan | 175/330 |
| 3,250,337 | 5/1966 | Demo | 175/343 |
| 3,461,983 | 8/1969 | Hudson et al. | 175/375 |
| 3,858,671 | 1/1975 | Kita et al. | 175/410 |
| 3,948,330 | 4/1976 | Langford, Jr. | 175/339 |
| 4,006,788 | 2/1977 | Garner | 175/330 |

(List continued on next page.)

FOREIGN PATENT DOCUMENTS

| | | | |
|---|---|---|---|
| 1241165 | 8/1960 | France | 175/333 |
| 1273460 | 9/1961 | France | 175/333 |
| 976007 | 11/1982 | U.S.S.R. | 175/333 |
| 1649083 | 5/1991 | U.S.S.R. | 175/332 |

OTHER PUBLICATIONS

"Kor-King" Diamond Boart Stratabit, 4 pages.
"readily available fluid, . . . ", 1 page.

*Primary Examiner*—Hoang C. Dang
*Attorney, Agent, or Firm*—Baker & Botts L.L.P.

[57] ABSTRACT

A rotary cone drill bit (10) with two-stage cutting action is provided. The drill bit (10) includes at least two truncated conical cutter assemblies (20) rotatably coupled to support arms (18), where each cutter assembly (20) is rotatable about a respective axis (44) directed downwardly and inwardly. The truncated conical cutter assemblies (20) are frusto-conical or conical frustums in shape, with a back face (60) connected to a flat truncated face (22, 62) by conical sides. The truncated face (22, 62) may or may not be parallel with the back face (60) of the cutter assembly (20). A plurality of primary cutting elements or inserts (24) are arranged in a predetermined pattern on the flat truncated face (22, 62) of the truncated conical cutter assemblies (20). The teeth (26) of the cutter assemblies (20) are not meshed or engaged with one another and the plurality of cutting elements (24) of each cutter assembly (20) are spaced from cutting elements (24) of other cutter assemblies (20). The primary cutting elements (24) cut around a conical core rock formation (40) in the center of the borehole, which acts to stabilize the cutter assemblies (20) and urges them outward to cut a full-gage borehole. A plurality of secondary cutting elements or inserts (52) are mounted in the downward surfaces of a dome area (50) of the bit body (12). The secondary cutting elements (52) cut down the free-standing core rock formation (42) when the drill bit (10) advances.

16 Claims, 3 Drawing Sheets

U.S. PATENT DOCUMENTS

| | | | |
|---|---|---|---|
| 4,058,177 | 11/1977 | Langford, Jr. et al. | 175/374 |
| 4,109,737 | 8/1978 | Bovenkerk | 175/329 |
| 4,148,368 | 4/1979 | Evans | 175/329 |
| 4,156,329 | 5/1979 | Daniels et al. | 51/295 |
| 4,203,496 | 5/1980 | Baker, III et al. | 175/329 |
| 4,285,409 | 8/1981 | Allen | 175/336 |
| 4,343,371 | 8/1982 | Baker, III et al. | 175/329 |
| 4,386,669 | 6/1983 | Evans | 175/269 |
| 4,444,281 | 4/1984 | Schumacher, Jr. et al. | 175/336 |
| 4,527,644 | 7/1985 | Allam | 175/333 |
| 4,545,441 | 10/1985 | Williamson | 175/329 |
| 4,592,433 | 6/1986 | Dennis | 175/329 |
| 4,595,067 | 6/1986 | Drake | 175/331 |
| 4,602,691 | 7/1986 | Weaver | 175/329 |
| 4,624,329 | 11/1986 | Evans et al. | 175/374 |
| 4,694,918 | 9/1987 | Hall | 175/329 |
| 4,705,124 | 11/1987 | Abrahamson et al. | 175/410 |
| 4,802,539 | 2/1989 | Hall et al. | 175/329 |
| 4,940,099 | 7/1990 | Deane et al. | 175/374 |
| 4,967,854 | 11/1990 | Barnetche-Gonzalez | 175/353 |
| 4,976,324 | 12/1990 | Tibbitts | 175/329 |
| 4,984,643 | 1/1991 | Isbell et al. | 175/341 |
| 5,131,480 | 7/1992 | Lockstedt et al. | 175/374 |
| 5,176,212 | 1/1993 | Tandberg | 175/333 |
| 5,346,026 | 9/1994 | Pessier et al. | 175/331 |
| 5,351,770 | 10/1994 | Cawthorne et al. | 175/374 |
| 5,394,952 | 3/1995 | Johns et al. | 175/332 |

ROTARY CONE DRILL BIT WITH TRUNCATED ROLLING CONE CUTTERS AND DOME AREA CUTTER INSERTS

TECHNICAL FIELD OF THE INVENTION

This invention is related in general to the field of drill bits. More particularly, the invention is related to a rotary drill bit with truncated rolling cone cutters and dome area cutter inserts.

BACKGROUND OF THE INVENTION

In the field of exploration and production of oil and gas, one type of drill bit or rock bit used for drilling earth boreholes is commonly known as a rotary cone drill bit. The typical rotary cone drill bit employs a multiplicity of rolling cone cutters rotatably mounted to extend downwardly and inwardly with respect to the central axis of the drill bit. The rolling cone cutters may have milled teeth or cutter inserts disposed on each cutter in predefined patterns. The predefined teeth or insert pattern of each rolling cone cutter are typically different from one another so that the teeth or inserts of the cone cutters mesh as the cone cutters are rotated. Constructed in this manner, the teeth or inserts located on the conical sides of the cutters do not create grooves in the borehole. Further, the meshing rotating teeth or inserts on the conical sides is capable of contacting and cutting the entire bottom of the borehole.

Although the typical rotary cone drill bit has been the tool of choice for drilling earthbore holes, several undesirable phenomenon affects the efficiency and performance of the bit. Note that the teeth or inserts located at or near the conical tips of the rolling cone cutters mesh and cut the center of the borehole. Because of the rotary cone drill bit configuration, the rotation at the conical tips of the rolling cone cutters travel the least amount of distance. Indeed, certain teeth or inserts may remain substantially stationary but for the rotational movement. Because the amount of cutting is directly related to the movement of the teeth or inserts, it is a poor translation of rotation energy to the cutting structures which generate little rock removal. Therefore, the center of the well bore presents a special challenge to the progress of the drilling.

One measure of the rotary cone drill bit's performance is its ability to maintain a consistent borehole diameter. This ability to hold gage is important to enable drill strings to be easily removed from and inserted into the borehole. Gage holding is particularly important for directional drilling applications. A further disadvantage associated with typical rotary cone drill bits is the tendency for the conical cutters to cut under-gage. As the drill bit advances, the rock formation tends to pinch or force the rolling cone cutters and the support arms inward. The result is a borehole that is under-gage.

SUMMARY OF THE INVENTION

Accordingly, there is a need for a rotary cone drill bit with improved penetration rate into hard rock formations.

In accordance with the present invention, a rotary cone drill bit with truncated conical cutter assemblies and dome area inserts are provided which eliminate or substantially reduce the disadvantages associated with prior drill bits.

In one aspect of the invention, a rotary cone drill bit with two-stage cutting action is provided. The drill bit includes at least two truncated conical cutter assemblies rotatably coupled to support arms, where each cutter assembly is rotatable about a respective axis directed downwardly and inwardly. The truncated conical cutter assemblies are frusto-conical or conical frustums in shape, with a back face connected to a flat truncated face by conical sides. The truncated face may or may not be parallel with the back face of the cutter assembly. A plurality of primary cutting elements or inserts are arranged in a predetermined pattern on the flat truncated face of the truncated conical cutter assemblies. The teeth of the cutter assemblies are not meshed or engaged with one another and the plurality of cutting elements of each cutter assembly are spaced from cutting elements of other cutter assemblies. The primary cutting elements cuts around a conical core rock formation in the center of the borehole, which acts to stabilize the cutter assemblies and urges them outward to cut a full-gage borehole.

In another aspect of the invention, a plurality of secondary cutting elements or inserts are mounted in the downward surfaces of a dome area of the bit body. The secondary cutting elements cuts down the free-standing core rock formation when the drill bit advances.

In yet another aspect of the invention, the cutter inserts mounted on the truncated face of the cutter assemblies and/or the dome area may be mounted with a rake angle to provide a more aggressive cutting action.

In yet another aspect of the invention, the cutter inserts may be doughnut-shaped and mounted on protruding nubs formed on the truncated face of the cutter assemblies and/or the dome area surfaces.

In another aspect of the invention, the doughnut-shaped cutter inserts may be mounted to mating contours formed in the surface, which mounts the inserts at a predetermined rake angle with respect to the surface.

One technical advantage of the present invention is the improved penetration rate of the rotary cone drill bit into hard formations. The ultra-hard cutter inserts or cutting elements mounted in the truncated face of the cutters are adapted to shear and cut the rock formation more efficiently. As the cutters rotate around the uncut core in the center of the borehole, the full 360° conical surface of the core is cut. This action relieves the in-situ stress of the formation, weakens the native rock, and enhances the drill bit penetration rate.

By leaving an uncut core rock formation in the center of the borehole, the truncated conical cutters are urged to rotate around it. This results in better directional stability of the cutters, especially when hard rock formation is encountered.

Further, by forcing the cutters to rotate around the core, the tendency for the outer wall of the borehole to pinch the support arms and cutters inward is reduced or eliminated. The result is an improvement in the performance of the drill bit and a full-gage borehole. The uncut core in the center of the borehole is then cut down by a secondary cutting structure or cutter inserts located in the dome of the bit body.

BRIEF DESCRIPTION OF THE DRAWINGS

For a better understanding of the present invention, reference may be made to the accompanying drawings, in which.

DETAILED DESCRIPTION OF THE INVENTION

Figure 1:
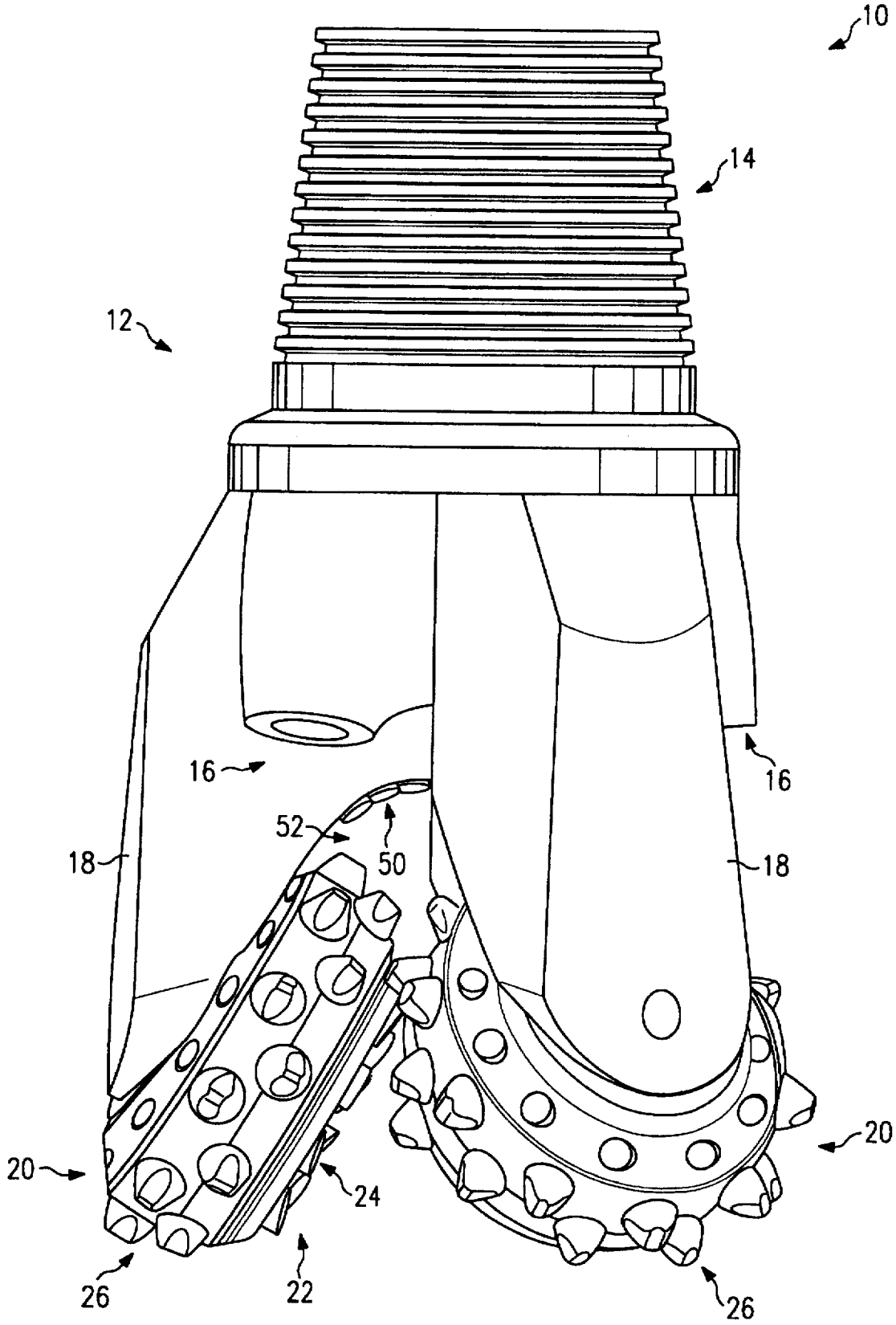
FIG. 1 is an isometric drawing of a rotary cone drill bit having truncated conical cutter assemblies and dome area cutter inserts constructed according to the teachings of the present invention.

The preferred embodiments of the present invention and its advantages are best understood by referring to FIGS. 1–8 of the drawings, like numerals being used for like and corresponding parts of the various drawings.

For purposes of illustration, the present invention is shown embodied in a rotary cone drill bit 10 used in drilling a borehole in the earth. Rotary cone drill bit 10 may also be referred to as a "rotary drill bit" or "rock bit." Rotary cone drill bit 10 preferably includes a bit body 12 with an upper threaded portion or pin 14 adapted for attaching to the lower end of a drill string (not shown). Threaded portion 14 and the corresponding threaded connection of the drill string allow for the rotation of drill bit 10 in response to the rotation of the drill string at the well surface (not shown). Bit body 12 includes a inner passage (not shown) that permits a cool drilling mud or like material to pass downward from the drill string. The drilling mud exits through nozzles 14 (two are shown), flows downward to the bottom of the borehole and then passes upward in the annulus between the wall of the borehole and the drill string, carrying drilling debris and rock chips therewith.

In the tri-cone rotary cone drill bit 10, three substantially identical arms 18 (two are shown) depend from bit body 12. Each arm 18 rotatably supports a truncated conical cutter assembly 20. The truncated conical cutter assembly 20 is generally frusto-conical in shape with the conical tip truncated. Each truncated conical cutter assembly 20 rotates about a downwardly and inwardly-defined axis of rotation. Truncated conical cutter assemblies 20 have truncated face 22 which define a central gap and are spaced apart from one another. A plurality of cutter inserts 24 are preferably mounted in a predetermined pattern on truncated face 22 of each conical cutter assembly 20. As shown, cutter inserts 24 are disposed on face 22 in a circular pattern, but other patterns may also be incorporated. Cutter inserts 24 of each cutter assembly 20 are spaced apart from cutter inserts 24 of other cutter assemblies 20 and do not mesh or engage in any manner. A resulting gap is defined between cutter inserts 24 of cutter assemblies 20. Preferably, cutter inserts 24 are manufactured from ultra-hard and abrasion-resistant materials such as polycrystalline diamond (PCD), thermally stable polycrystalline diamond (TSP), and cubic boron nitride (CBN). Each truncated conical cutter assembly 20 further includes a plurality of cutting elements or teeth 26 arranged in rows and projecting outwardly from the conical surface of cutter assembly 20.

Figure 2:
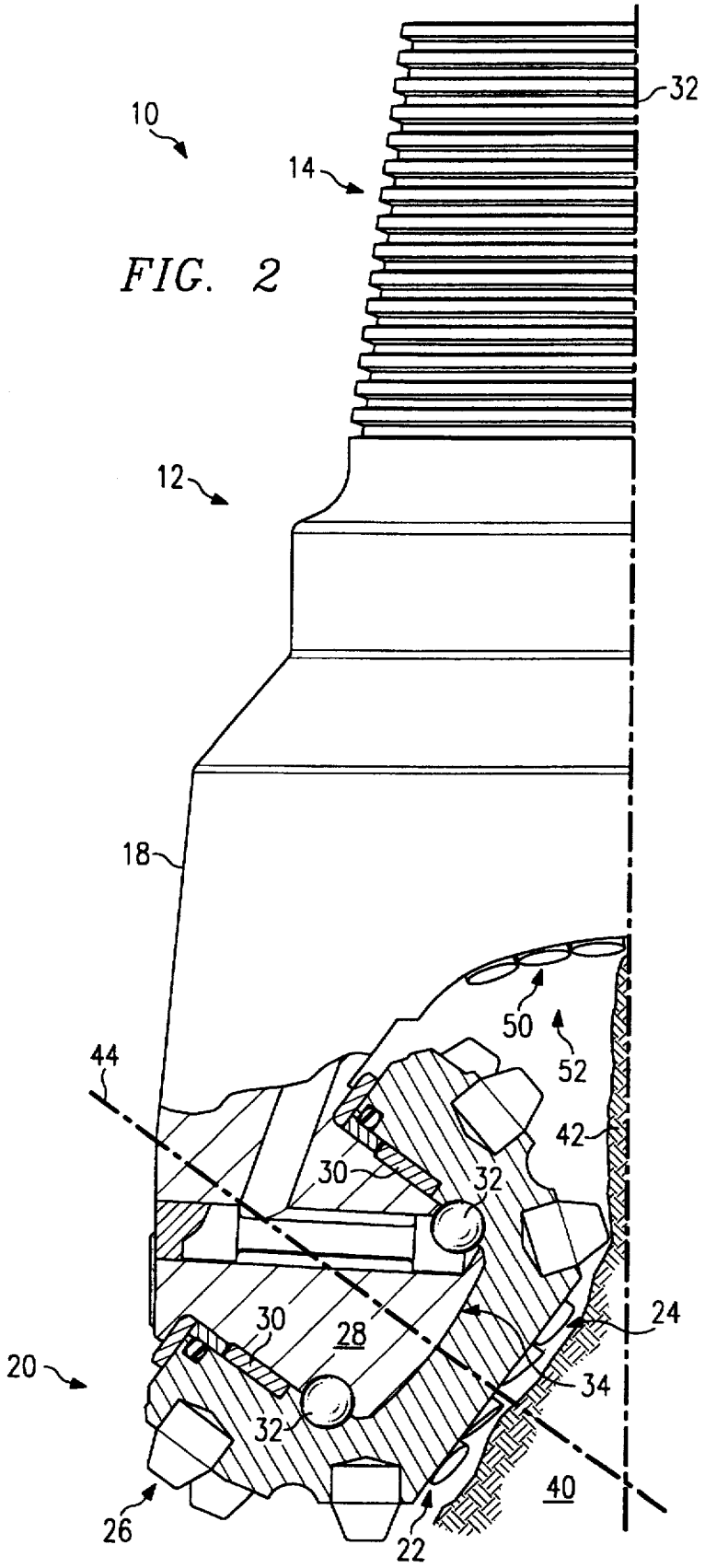
FIG. 2 is a side view of the a portion of the rotary cone drill bit showing a truncated conical cutter assembly, dome area cutter inserts, and a central core rock formation.

The drilling or cutting action of drill bit 10 occurs as truncated conical cutter assemblies 20 are rotated about the respective axes around the bottom of the borehole. FIG. 2 is a partial cross-sectional side view of one truncated conical cutter assembly 20 depending from a spindle 28 mounted in a support arm 18 in the process of drilling the borehole. Cutter assembly 20 further includes a plurality of roller bearing assemblies 30 in rotational bearing engagement with spindle 28. Cutter assembly 20 is retained on spindle 28 by a plurality of ball bearings 32 inserted through a ball passage 34 in spindle 28. As shown, spindle 28 has a large thrust bearing engagement surface area 34 with the internal cavity of cutter assembly 20. This is an improvement over the conventional thrust button configuration with the attendant advantage of better bearing life. Further, as a result of the truncated cone configuration, the spindle length may be shortened to reduce the stress placed on the spindle and the bearings during drilling.

Because cutter assemblies 20 have truncated faces 22 and do not have teeth or cutter inserts that mesh with one another, a core rock formation 40 may be formed in the center of the borehole generally along a center longitudinal axis of drill bit 10 as cutter assemblies 20 rotatably cut out the bottom of the borehole. The conical core rock formation 40 is cut and reduced on all sides by cutter inserts 24 located on truncated face 22 of cutter assemblies 20 and rotating about cutter assembly axes 44. Constructed in this manner, conical core rock formation 40 serves as a stabilizing structure with a 360° surface to force cutter assemblies 20 to rotate thereabout. Conical core rock formation 40 further serves as a bearing surface which urges rotating cutter assemblies 20 outward to drill a full-gage well bore in hard formations.

The resulting narrow cylindrical formation 42 extending above conical core base 40 may not have sufficient structural integrity and may crumble and fall without further cutting. At times however, narrow core 42, which may range between ¼ inch to one inch in diameter, may remain standing. Note that the degree of incline of cutter assembly axis 44 may determine the configuration and thickness of core rock formation 42.

The narrow cylindrical core formation 42 left standing unsupported in the center of the borehole is cut down by a secondary cutting structure or cutting elements mounted in a dome area 52 located on the underside of bit body 12. The secondary cutting structure may be implemented by a plurality of cutter inserts 50 arranged in a predefined pattern in dome area 52. Dome area cutter inserts 50 are preferably manufactured from ultra-hard and abrasion-resistant polycrystalline diamond materials and the like to achieve efficient shear cutting of core formation 42. Therefore, as bit body 12 rotates about its center longitudinal axis 32, dome area cutter inserts 50 rotatably shear off the top of narrow cylindrical core formation 42. Because of the proximity to the cool drilling mud flowing through bit body 12, heat generated in dome area cutter inserts 52 is quickly, dissipated by transferring to bit body 12 and the drilling mud.

Figure 3:
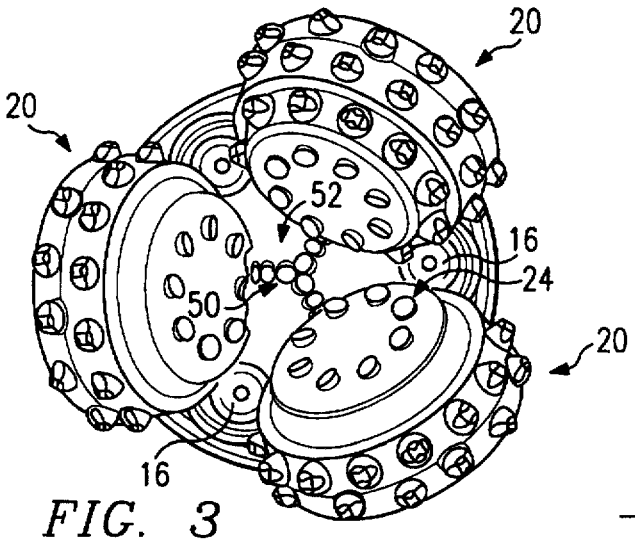
FIG. 3 is a view of the dome area of the rotary cone drill bit showing dome area cutter inserts constructed according to the teachings of the present invention.

FIG. 3 is a bottom view of rotary cone drill bit 10 showing dome area cutter inserts 50 located in dome area 52 of bit body 12. Also shown are cutter inserts 24 mounted on truncated face 22 of truncated conical cutter assemblies 20. It is apparent from this view that cutter assemblies 20 are spaced from one another with no teeth or cutting structure meshed or interlaced. Cutter inserts 24 located on the truncated face of cutter assemblies 20 can be said to represent a primary cutting structure for working the center of the borehole, and dome area cutter inserts 52 represent a secondary cutting structure for finally cutting down the core rock formation formed by the primary cutting structure.

Constructed in this manner, rotary cone drill bit 10 provides an improved penetration rate. Ultra-hard cutter inserts 24 or the primary cutting structure mounted in truncated face 22 of cutter assemblies 20 are adapted to shear and cut the center of the borehole more efficiently. As cutter assemblies 20 rotate around uncut core 40 in the center of the borehole, the full 360° conical surface thereof is cut and worn down. This action relieves the in-situ stress of the formation and weakens the native rock.

By leaving uncut core rock formation 40 in the center of the borehole, truncated conical cutter assemblies 20 are urged to rotate around it. This results in better directional stability of cutter assemblies 20, especially when hard rock formation is encountered. Further, by forcing cutter assemblies 20 to rotate around conical core 40, the tendency for the outer wall of the borehole to pinch support arms 18 and cutter assemblies 20 inward is reduced or eliminated. The result is an improvement in the performance of the drill bit and a full-gage borehole.

Figure 4:
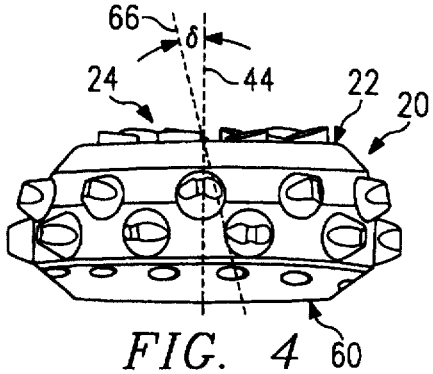
FIG. 4 is a side view of a truncated conical cutter assembly constructed in accordance with the teachings of the present invention.

Referring to FIG. 4, a side view of truncated conical cutter assembly 20 is shown. Truncated conical cutter assembly 20 is a conical frustum having truncated face 22 generally parallel a back face 60 which forms the base of the cone. Cutter inserts 24 located on truncated face 22 therefore lie on a line (not shown) generally parallel to back face 60.

Figure 5:
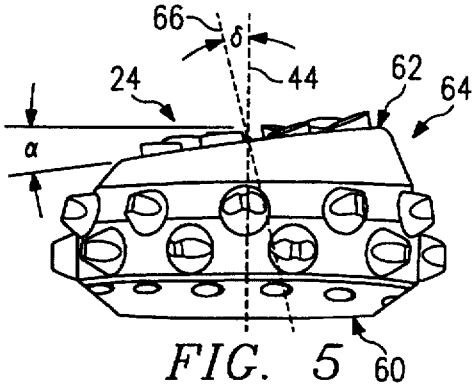
FIG. 5 is a side view of an angled truncated conical cutter assembly constructed in accordance with the teachings of the present invention.

Another embodiment of truncated conical cutter assembly 20 presents truncated face cutter inserts 24 on an inclined truncated face 62 with respect to back face 60 in cutter assembly 64 shown in FIG. 5. The angle of incline, α, may range from zero to 45°, inclusively, where truncated face 62 at a zero-degree incline is parallel to back face 60.

In a tri-cone rotary cone drill bit 10, the three cutter assemblies 64 may have truncated faces with different angles of incline. For example, two cutter assemblies may have parallel truncated faces, and the third may have an angled truncated face. Alternatively, one cutter assembly may have a parallel truncated face, the second may have a truncated face at a selected angle, and the third may have a truncated face at a greater angle. The angles and configuration of the cutter assemblies may be determined based on application and experimentation. Cutter inserts 24 placed on the inclined truncated face 62 may cut and shear rock more aggressively resulting in a center core rock formation 40 with slightly different configuration and/or size.

A further variation and alternate embodiment in the truncated conical cutter assembly is to slightly offset or skew the rotational axis 44 by a predetermined angle, δ, so that the rotation of the cutter assemblies is about the offset axis 66, as shown in FIGS. 4 an 5. The offset rotational axis 66 may be achieved by mounting the truncated conical cutter assemblies 20 on the spindles 28 at an angle to introduce the desired offset. The offset cutter assemblies may cut more aggressively into core rock formation 40 and/or the outer wall of the borehole. In a drill bit, one or more of the cutter assemblies may be offset to improve the penetration rate of the bit.

Figure 6A:
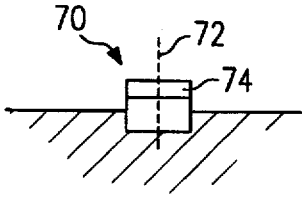
FIGS. 6A and 6B are cross-sectional views of a cutter insert located on the truncated face of the cutter assembly or in the dome area.
Figure 6B:
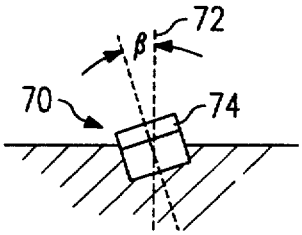
Figure 7A:
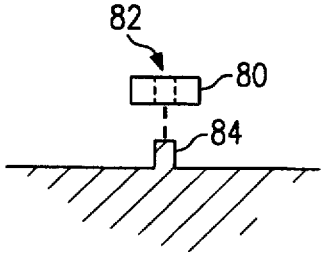
FIGS. 7A and 7B are cross-sectional views of a doughnut-shaped cutter insert and mounting nub constructed according to the teachings of the present invention.
Figure 7B:
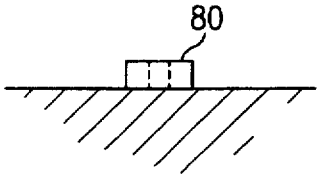

FIGS. 6A and 6B show that cutter inserts 70 for truncated face 22 or 62 and dome area 50 may be installed either with its longitudinal axis 72 perpendicular to the surface or with a rake angle, β. The rake angle, β, may be defined as ranging approximately between 0°–45°, inclusively. Preferably, the rake angle may be approximately 20°–35° for the dome area cutter inserts, and approximately 15°–25° for the truncated face cutter inserts. The rake angle permits a more aggressive bite and an artificial thickening of the ultra-hard polycrystalline diamond layer 74 of the inserts to improve the service life thereof. The cutter inserts 70 are preferably brazed, sintered, or secured by other like methods into mating holes formed or pre-fabricated in the surface of truncated face or dome area.

Where material depth in the surface of the truncated face 22 or 62 or dome area 50 is insufficient or not suited for the cutter insert installation described above, an alternative embodiment may be used. As shown in FIGS. 7A and 7B, a doughnut-shaped cutter insert 80 with a center hole 82 defined therein may be brazed or otherwise attached to a protrusion or nub 84 formed on the surface. The shape of nub 84 preferably conforms with the shape of center hole 82 to ensure a secure bond therebetween. This installation configuration obviates the need for a certain thickness required to form the mating holes, increases the surface area available for bond formation, and is adapted in particular to truncated face and dome area installations.

Figure 8A:
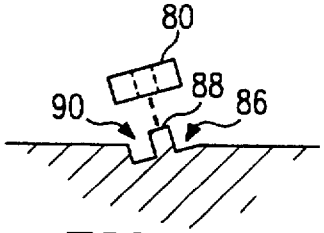
FIGS. 8A and 8B are cross-sectional views of a doughnut-shaped cutter insert and a rake angle mounting nub constructed according to the teachings of the present invention.
Figure 8B:
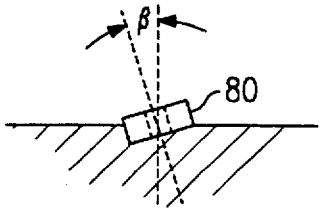

To achieve a rake angle, β, as described above, a mating contour 86 may be pre-fabricated in the surface of the material, as shown in FIGS. 8A and 8B. In particular, mating contour 86 may include a nub 88 and a shallow indentation 90. When cutter insert 80 is bonded to mating contour 86, a rake angle of the desired magnitude is achieved.

Doughnut-shaped cutter insert 80 may be recycling utilization of scrap material discarded in the manufacture of polycrystalline diamond compacts (PDCs). The PDCs are stamped out of the material, leaving a center hole in a circular piece of material. Accordingly, the use of doughnut-shaped cutter inserts 80 is economical and does not require special manufacturing.

A rotary cone drill bit, when constructed according to the teachings of the present invention, achieves a better penetration rate by improving the cutting action in the center of the borehole where drilling is the slowest with conventional drill bits. The primary cutting structure or elements on the flat face of the truncated conical cutter assemblies leaves a conical rock core uncut in the center of the borehole, which provides the added advantage of stabilizing the rotating cutter assemblies and cutting a full-gage hole. The core is finally cut down with a secondary cutting structure located in the dome area of the bit body.

Although the present invention and its advantages have been described in detail, it should be understood that various changes, substitutions and alterations can be made therein without departing from the spirit and scope of the invention as defined by the appended claims.

What is claimed is:

1. A rotary cone drill bit having a rotatable bit body and at least two support arms extending therefrom, said support arms defining a dome area below said bit body, comprising:

at least two truncated conical cutter assemblies rotatably coupled to said support arms and each rotatable about a respective axis directed downwardly and inwardly, said truncated conical cutter assemblies being conical flustums in shape having a back face connected to a flat truncated face by conical sides, said back face and said truncated face having a predetermined angled relationship;

a plurality of primary cutting elements arranged in a predetermined pattern and coupled to said flat truncated face of said truncated conical cutter assemblies, said plurality of curing elements of each cutter assembly being in spaced relationship with respect to cutting elements of other cutter assemblies; and a plurality of secondary cutting elements mounted in downward facing surfaces of said dome area of said bit body, wherein said plurality of primary cutting elements are doughnut-shaped ultra-hard inserts mounted on nubs formed in flat truncated face of said cutter assemblies.

2. The rotary cone drill bit, as set forth in claim 1, further comprising:

a plurality of mating contours formed on said flat truncated face of said cutter assemblies, said mating contours having said protruding nub extending at an angle from said face; and said plurality of doughnut-shaped inserts bonded to said mating contours.

3. A rotary cone drill bit having a rotatable bit body and at least two support arms extending therefrom, said support arms defining a dome area below said bit body, comprising:

at least two truncated conical cutter assemblies rotatably coupled to said support arms and each rotatable about a respective axis directed downwardly and inwardly, said truncated conical cutter assemblies being conical frustums in shape having a back face connected to a flat truncated face by conical sides, said back face and said truncated face having a predetermined angled relationship;

a plurality of primary cutting elements arranged in a predetermined pattern and coupled to said flat truncated face of said truncated conical cutter assemblies, said plurality of cutting elements of each cutter assembly being in spaced relationship with respect to cutting elements of other cutter assemblies; and a plurality of secondary cutting elements mounted in downward facing surfaces of said dome area of said bit body and rotating therewith, and wherein said plurality of secondary cutting elements are doughnut-shaped ultra-hard inserts mounted on nubs formed in dome area surfaces of said bit body.

4. The rotary cone drill bit, as set forth in claim 3, further comprising:

a plurality of mating contours formed on downward facing surfaces of said dome area, said mating contours having said protruding nub extending at an angle from said face; and said plurality of doughnut-shaped inserts bonded to said mating contours.

5. An earth-boring drill bit cutter assembly, comprising:

a frusto-conical body having a back face connected to a substantially flat truncated face by conical sides;

a plurality of cutter elements arranged in rows and disposed on said conical sides;

a plurality of nubs protruding from said substantially flat truncated face; and a plurality of doughnut-shaped inserts bonded to said nubs.

6. The cutter assembly, as set forth in claim 5, further comprising:

a plurality of mating contours in said substantially flat truncated face, said mating contours including said nub protruding therefrom at an angle; and said plurality of doughnut-shaped inserts bonded to said mating contours.

7. A method for manufacturing a rotary cone drill bit having a bit body and a predetermined number of support arms depending therefrom forming a dome area under said bit body, comprising the steps of:

forming the same predetermined number of truncated conical cutter assemblies, each cutter assemblies being frusto-conical in shape having a back face connected to a substantially flat truncated face by conical sides, said cutter assemblies being adapted to rotate about respective rotational axes thereof in spaced relation with one another;

bonding a plurality of cutter inserts to said flat truncated face of said cutter assemblies; and bonding a plurality of cutter inserts to downward facing surfaces of said dome area; and wherein said cutter insert bonding to said flat truncated face step further comprises the steps of:

forming a plurality of protruding nubs on said flat truncated face of said cutter assemblies; and bonding a plurality of doughnut-shaped cutter inserts to said nubs and surrounding surface areas.

8. The method, as set forth in claim 7, wherein said cutter insert bonding to said flat truncated face step further comprises the steps of:

forming a plurality of mating contours on said flat truncated face of said cutter assemblies, said mating contours each having said protruding nub extending above said flat truncated face at an angle; and bonding said plurality of doughnut-shaped cutter inserts to said mating contours.

9. The method, as set forth in claim 8, wherein said mating contour forming step comprises the step of extending said nub at said angle ranging between 0–45° inclusively.

10. The method, as set forth in claim 8, wherein said mating contour forming step comprises the step of extending said nub at said angle ranging between 15–25° inclusively.

11. A method for manufacturing a rotary cone drill bit having a bit body and a predetermined number of support arms depending therefrom forming a dome area under said bit body, comprising the steps of:

forming the same predetermined number of truncated conical cutter assemblies, each cutter assemblies being frusto-conical in shape having a back face connected to a substantially flat truncated face by conical sides, said cutter assemblies being adapted to rotate about respective rotational axes thereof in spaced relation with one another;

bonding a plurality of cutter inserts to said flat truncated face of said cutter assemblies; and bonding a plurality of cutter inserts to downward facing surfaces of said dome area; and wherein said cutter insert bonding to said dome area step further comprises the steps of:

forming a plurality of protruding nubs on said downward facing surfaces, of said dome area; and bonding a plurality of doughnut-shaped cutter inserts to said nubs and surrounding surface areas.

12. The method, as set forth in claim 11, wherein said cutter insert bonding to said dome area further comprises the steps of:

forming a plurality of mating contours on said dome area, said mating contours each having a protruding nub extending above said dome area at an angle; and bonding said plurality of doughnut-shaped cutter inserts to said mating contours.

13. The method, as set forth in claim 12, wherein said mating contour forming step comprises the step of extending said nub at said angle ranging between 0°–45° inclusively.

14. The method, as set forth in claim 12, wherein said mating contour forming step comprises the step of extending said nub at said angle ranging between 15°–25° inclusively.

15. A rotary cone drill bit having a rotatable bit body and at least two support arms extending therefrom comprising:

at least two truncated conical cutter assemblies rotatably coupled to said support arms and each rotatable about a respective axis directed downwardly and inwardly, said truncated conical cutter assemblies being conical frustums in shape having a back face connected to a flat truncated face by conical sides, said back face and said truncated face having a predetermined angled relationship;

said truncated conical cutter assemblies being spatially located to form a core in the center section of the borehole;

a plurality of cutting elements arranged in a predetermined pattern and coupled to said flat truncated face of said truncated conical cutter assemblies, said plurality of cutting elements of each cutter assembly being in spaced relationship with respect to cutting elements of other cutter assemblies; and said plurality of cutting elements are doughnut-shaped ultra-hard inserts mounted on nubs formed in said flat truncated face of said cutter assembly.

16. The rotary cone drill bit, as set forth in claim 15, further comprising:

a plurality of mating contours formed on said flat truncated face of said cutter assemblies, said mating contours having said protruding nub extending at an angle from said face; and said plurality of doughnut-shaped inserts bonded to said mating contours.

* * * * *